US007818948B2

(12) United States Patent
Cannon

(10) Patent No.: US 7,818,948 B2
(45) Date of Patent: Oct. 26, 2010

(54) METHOD AND APPARATUS FOR EVACUATING RE-SEALABLE BAGS

(76) Inventor: Thomas Calvin Cannon, 1010 Eastbourne Dr., La Plata, MD (US) 20646

( * ) Notice: Subject to any disclaimer, the term of this patent is extended or adjusted under 35 U.S.C. 154(b) by 0 days.

(21) Appl. No.: 12/584,656

(22) Filed: Sep. 10, 2009

(65) Prior Publication Data

US 2010/0192518 A1 Aug. 5, 2010

Related U.S. Application Data

(63) Continuation-in-part of application No. 12/322,290, filed on Feb. 2, 2009, now abandoned.

(51) Int. Cl.
*B65B 31/00* (2006.01)

(52) U.S. Cl. ..... 53/434; 53/79; 53/403; 53/410; 53/512

(58) Field of Classification Search ..... 53/79, 53/85, 86, 403, 408, 410, 510, 512
See application file for complete search history.

(56) References Cited

U.S. PATENT DOCUMENTS 4,164,111 A * 8/1979 Di Bernardo ..... 53/434
4,457,122 A * 7/1984 Atkins et al. ..... 53/434
4,583,347 A * 4/1986 Nielsen ..... 53/434
4,926,614 A * 5/1990 Costello et al. ..... 53/434
5,056,292 A * 10/1991 Natterer ..... 53/86
5,435,114 A * 7/1995 Moehlenbrock et al. ..... 53/434
6,488,972 B1 * 12/2002 Cerani ..... 426/110
7,140,167 B2 * 11/2006 Countz ..... 53/510
2004/0060262 A1 * 4/2004 Harges et al. ..... 53/434

* cited by examiner

*Primary Examiner*—Thanh K Truong

(57) ABSTRACT

The present invention is a method and apparatus for quickly, reliably, and inexpensively evacuating air from ordinary re-sealable plastic bags without employing special adapters to interface with vacuum pumps. The system consists of a vacuum pump, an outer re-sealable plastic bag that acts as a flexible vacuum chamber, a vacuum tray that fits inside the outer plastic bag and prevents the outer bag from collapsing onto the vacuum port. Users operate the system by inserting the re-sealable bag to be evacuated inside the outer plastic bag until the seal of the inner bag is in the proper sealing position inside the vacuum tray. The user then seals the outer bag, turns on the vacuum pump and allows the vacuum process to run to completion, during which the re-sealable inner bag is automatically sealed by the device. The user then opens the outer plastic bag and removes the vacuum-packed inner bag.

2 Claims, 5 Drawing Sheets

METHOD AND APPARATUS FOR EVACUATING RE-SEALABLE BAGS

This is a Continuation-in-Part (CIP) of prior application Ser. No. 12/322,290 with filing date Feb. 2, 2009 now abandoned; and Art Unit 3721; Examiner TRUOHG, THANH K; and Confirmation No. 5326; that replaces the prior application in its entirety.

This invention relates to evacuating air from ordinary re-sealable plastic bags without modifying the bags to mate with vacuum apparatus. More particularly, this invention relates to enclosing re-sealable bags in a larger re-sealable plastic bag that is married to a vacuum pump that simultaneously evacuates air from both the inner and outer re-sealable bags. This system allows users to vacuum pack food and other items in ordinary re-sealable plastic bags, without incurring the costs of more expensive special re-sealable plastic bags that have been modified to mate with vacuum apparatus. In addition, this system affords users more space inside the re-sealable bags since none of the bags' internal space is taken up by vacuum ports or other features that enable interfacing with external vacuum apparatus.

BACKGROUND OF THE INVENTION

Re-sealable plastic bags are widely used to preserve food. Such bags are referred to as "re-sealable plastic bags" and typically have a mating male rib or bead and female channel extending along the opening of the bag that form an airtight closure when pressed together along the length of the bag seal. Naito, U.S. Pat. No. RE 28,969 discloses an example of an airtight profile closure used in the ZIPLOC® storage bag. The airtight closure is typically formed as an integral part of the bag and allows products stored in the bag to be easily removed and re-stored.

Re-sealable plastic bags help preserve food by limiting the amount of oxidizing air to which the food is exposed. However, since ordinary re-sealable bags expose the food inside to the air entrapped in the bags, it is desirable to evacuate or vacuum seal the bag. In sealing such re-sealable bags, users typically manually squeeze air from the bag while simultaneously closing the opening. Unfortunately, some air remains in the bag, and air can re-enter and become trapped in the bag during the initial sealing or re-sealing process.

Others have attempted to overcome problems associated with manually sealing re-sealable bags by modifying the closure, providing specially designed bags, or providing bag attachments for evacuating the bag.

Kugler, U.S. Pat. No. 3,339,606 discloses a tongue and grove profile closure wherein the tongue thickness is less than the width of the groove, and a releasable pressure sensitive adhesive is provided to keep the tongue within the groove. Adhesives, however, are difficult to apply, and may cause undesirable problems by sticking to other bags or surfaces.

Goto et al, U.S. Pat. No. 5,701,996 discloses a specially designed snap-fastener bag having an air evacuation passage along a bottom-seal and a conventional snap fastener along the bag opening. The air evacuation passage has an opening through one side of the bag and a sticky substance is disposed in the passageway to adhere the top and bottom surfaces of the plastic film of the bag after manually evacuating the bag.

Cox, U.S. Pat. No. 5,544,752, and Lambert, U.S. Pat. No. 6,085,906 disclose specially constructed vacuum storage bags having an integrally formed flexible conduit directed through the bag and into the interior of the bag, and sealing strips positioned within or on the exterior of the conduit so that pressure applied to an exterior of the conduit will cause the conduit to collapse and engage the conduit sealing strips and prevent fluid flow through the conduit.

Tretina, U.S. Pat. No. 7,389,629 discloses a portable, hand-operated vacuum pump designed to interface with re-sealable plastic bags that incorporate a simple one-way vacuum value. The disadvantages of this approach are that the system requires users to purchase special re-sealable bags, and the said vacuum valves reduces the amount of available storage volume inside the bags.

Kaufman, U.S. Pat. No. 4,018,253 discloses a vacuum device for freezer bags which includes a hollow retainer member designed to mate with the open end of the bag, and a cap member designed to make an airtight connection with the outside surface of the retainer. A flexible tube extends downwardly through the bottom end of the cap member and upwardly above the cap member, and a valve is provided on the upward part of the tube. The open end of the bag is inserted through the hollow retainer and draped over the top end of the retainer, and the cap is mounted over the top surface of the retainer and the open end of the bag in airtight manner so that the tube passage makes an airtight connection with the interior of the bag. Air is withdrawn from the container through the tube, and the valve on the tube is then closed to close the tube passage.

Others have attempted to overcome problems associated with manually sealing conventional re-sealable bags by providing nozzle attachments that are connected to a household vacuum cleaner hose for evacuating the bag. Such systems require users to handle bulky vacuum cleaners to perform a simple kitchen task.

Brown, U.S. Pat. No. 6,763,857 discloses a vacuum attachment for use with a vacuum hose and a vacuum device, and a conventional plastic food storage bag. The vacuum attachment has one hollow attachment for joining the vacuum attachment to the vacuum hose, and a cylindrical member for inserting the vacuum attachment into the bag. The vacuum attachment may also have an air flow blocker for blocking the air flow between the bag and the vacuum attachment. The air flow blocker is a hollow cylindrical cap with a closed end, and may be equipped with an opening or a filter.

Smith, U.S. Pat. No. 5,873,217 discloses a vacuum sealing method and nozzle adaptor apparatus for sealing a container such as a zipper-type plastic bag. The nozzle adapter has an elongated nozzle end for insertion into the container or bag and a larger vacuum hose for connecting to an existing vacuum source such as household vacuum cleaner. The elongate end of the nozzle is placed in the bag, the bag is sealed as completely as possible around the nozzle, and the vacuum source is turned on. After the air is withdrawn from the bag, the nozzle is quickly removed from the bag and the open portion of the zipper-type seal is quickly engaged before a substantial amount of air can return into the bag.

Lau, U.S. Pat. No. 5,287,680 employs a hand-held battery operated vacuum packing device for evacuating and sealing conventional plastic bags. The device has a housing with a pair of jaws mounted on a lever with a slot between the said jaws and lever through which the edges of the bag are pulled to press the edges together. A nozzle extends outwardly from the housing and an air extractor fan in the housing sucks air from the bag just prior to sealing. With the jaws in an open position, the two mating edges of the bag are threaded together into the slot between the two jaws, and the nozzle is placed in the bag. The lever is then operated to close the jaws. The bag and the vacuum packing device are then pulled in opposite directions, so that the two edges of the bag are pulled past the nozzle and through the slot into sealing engagement with one another. When the bag is nearly completely sealed along its opening, the extractor fan is operated to extract air from the bag through the nozzle. The lever is then released to open the jaws and the nozzle is withdrawn, and the bag manually sealed.

Nguyen, U.S. Pat. No. 7,316,101 attempts to minimize the flow of air back into a sealed plastic bag by depositing a fluid along the seal to improve its leak resistance, and inserting a hollow vacuum tube in the corner of the bag to evacuate the bag. Users manually apply pinching pressure to sandwich the evacuation tube between the unclosed portion of the seal to prevent air from escaping. After a vacuum is drawn in the bag, users must quickly pull out the evacuation tube so that the pinching pressure is transferred to the closure thereby closing the unclosed portion of the seal. This process not only allows air to reenter the bag while the probe is being withdrawn, but also runs the risk of contaminating the contents of the bag with micro-organisms that may be on the probe.

A variety of specially designed large storage bags having air valve arrangements are also known in the art, such as disclosed in Yeager, U.S. Pat. No. 5,829,884 and Koyanagi, U.S. Pat. No. 6,499,600, have been proposed for the purpose of removing air from the storage bags in order to reduce the volume of an item, such as clothing, inside the bag to minimize required storage space.

A variety of combination vacuum and heat sealing devices are known in the art. Most of these types of heat sealing devices are not well suited for conventional re-sealable plastic bags because the heat source typically burns through conventional thin-walled re-sealable bags. Further, such heat-sealing systems are relatively expensive, and their large size prohibits them from being stored in ordinary kitchen drawers.

Accordingly, a need exists for a vacuum sealing system that allows users to vacuum pack the contents of re-sealable flexible plastic bags without experiencing the drawbacks of existing art.

The present invention is distinguished from prior art in general, and these cited patents in particular, by a vacuum sealing method and apparatus that can be used with ordinary re-sealable plastic bags. The system does not require modifying the bags or inserting any type of vacuum probe or adapter into the bags, thereby reducing both cost and complexity while simultaneously improving reliability and ease of use.

The present vacuum sealing method and apparatus for evacuating air from re-sealable plastic bags overcomes the problems with prior art by enclosing the re-sealable bag inside a larger vacuum chamber that evacuates air from the entire system. Further, the system automatically closes the re-sealable bag when the desired vacuum level is reached. This automatic closure feature is very important because once the bag collapses around its contents; the seal becomes immobile, and cannot be moved by hand. The collapsed bag freezes the seal in place whether or not the seal is closed or open. If the seal is not closed, then the vacuum will be lost when the inner bag is removed from the vacuum chamber. Although the sealing action may be accomplished using mechanical devices that feed through the walls of a rigid vacuum chamber, a simpler and more effective approach is to employ a vacuum chamber having flexible walls, and containing apparatus inside the vacuum chamber that automatically performs the sealing operation. A practical way of implementing a flexible vacuum chamber is to employ a larger, flexible re-sealable bag as the vacuum chamber. However, such a system requires preventing the flexible wall of the vacuum chamber from prematurely collapsing around the vacuum port and stopping the vacuum process before reaching the desired vacuum level. The present system prevents such uncontrolled collapse of the flexible vacuum chamber by incorporating a structure inside the vacuum chamber that controls the way the larger bag collapses around the inner bag and vacuum port. This inner structure is referred to as a vacuum tray and incorporates all of the features needed to quickly, reliably, and inexpensively perform the vacuuming and sealing operations. Such features include a vacuum port; a frame that prevents the outer bag from collapsing around the vacuum port; a well that collects fluids that may be forced from the inner re-sealable bag and prevents aspiration of fluids into the vacuuming apparatus; a shelf for sealing the inner re-sealable bag, a ramp that guides the inner bag onto the sealing shelf; components that cause the collapsing outer bag to activate the sealing mechanism of the inner bag; and a means for inexpensively mating the outer bag and vacuum port to external vacuuming apparatus.

BRIEF SUMMARY OF THE INVENTION

This invention is a method and apparatus for quickly and inexpensively exhausting air from ordinary re-sealable plastic bags. This invention solves the problem of vacuum packing machines only working with special bags provided by the manufacturer of the vacuuming apparatus. This invention also solves the problem that general purpose vacuuming machines, such as vacuum cleaners, require special adapters to interface with ordinary re-sealable bags, with different adapters needed for different bags and different bag sizes. This invention allows users to vacuum pack any commercially available re-sealable plastic bag, without using any special adapters to interface the system to the re-sealable bag. This invention works by inserting the re-sealable bag to be vacuumed into a larger re-sealable bag that constitutes a flexible vacuum chamber. Air is then evacuated from the flexible vacuum chamber, which collapses around the open inner re-sealable bag, thereby creating a vacuum in the inner re-sealable bag as well. As it collapses, the larger re-sealable bag activates the sealing mechanism of the inner re-sealable bag, thereby closing it shut, and preserving the vacuum. The inner re-sealable bag is then removed from the outer re-sealable bag.

DETAILED DESCRIPTION OF THE INVENTION

This invention takes advantage of a key principle of physics: All of the space inside a vacuum chamber experiences the same vacuum level. This means that if an open re-sealable bag and its contents are placed inside a vacuum chamber, the inside of the re-sealable bag will be evacuated to the same level as rest of the space inside the vacuum chamber. Secondly, since there will always remain some amount of air in the vacuum chamber, and the air density will be uniform throughout the vacuum chamber, the amount of residual air trapped inside the re-sealable bag can be minimized by squeezing the re-sealable bag down to its smallest possible volume prior to re-sealing the bag. This translates into making the re-sealable plastic bag conform as closely as possible to its contents. Accordingly, the optimal method of evacuating a re-sealable bag is to place the opened bag inside a collapsible vacuum chamber, draw down a vacuum, allow the collapsible vacuum chamber to force the re-sealable bag to shrink around its contents, and then seal the bag prior to releasing the vacuum. The present invention automatically accomplishes all of these steps, as illustrated in the accompanying drawings.

Figure 1C:
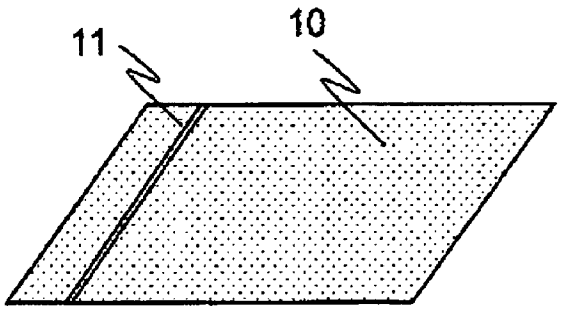
FIG. 1C shows the re-sealable bag, 14, that becomes vacuum packed.
Figure 1A:
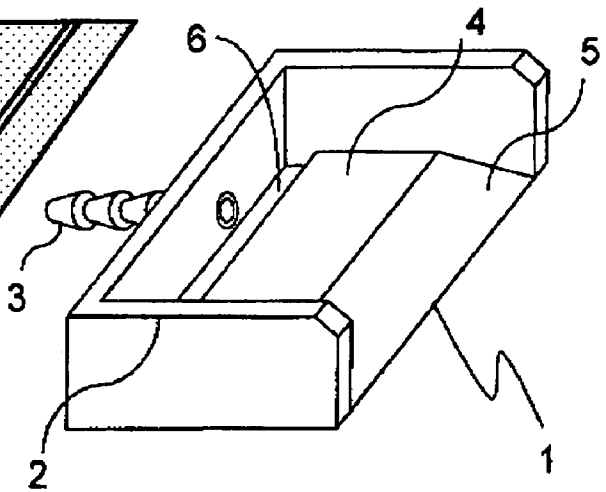
FIG. 1A is a schematic of the vacuum tray, 1, that shows its principal features
Figure 1B:
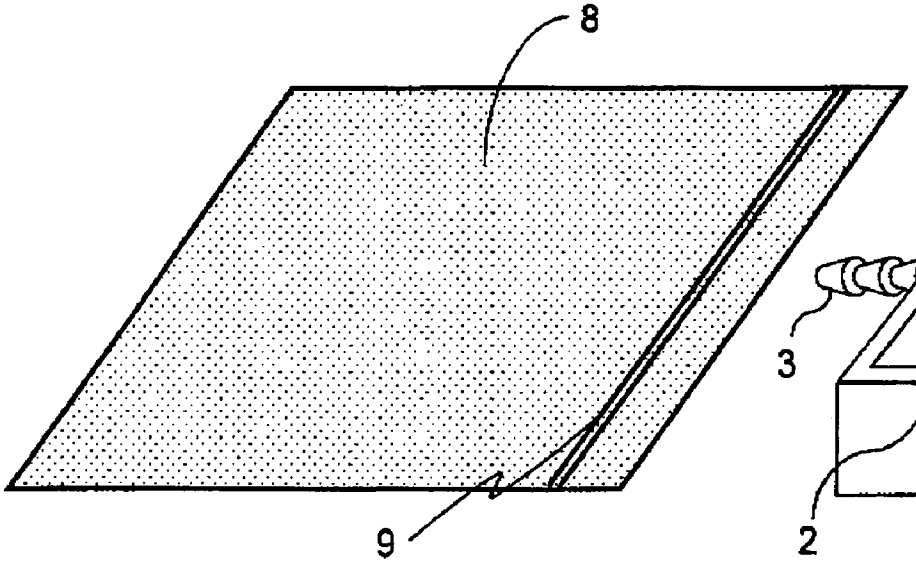
FIG. 1B shows the large vacuum bag, 8, which serves as a flexible vacuum chamber

FIG. 1A, FIG. 1B, and FIG. 1C show the three major components of the system. The system us assembled by inserting the vacuum tray, 1, shown in FIG. 1A, through the open vacuum bag seal, 9, shown in FIG. 1B, into the vacuum bag, 8, shown in FIG. 1B. The barbed tray port, 3, shown in FIG. 1A, pierces the closed end of the vacuum bag, 8, shown in FIG. 1B, to allow the tray port, 3, to mate with a vacuum source. The re-sealable bag, 14, shown in FIG. 1C, contains the material to be vacuum packed and is inserted through the open vacuum bag seal, 9, shown in FIG. 1B, until it rests on the sealing shelf, 4, shown in FIG. 1A.

FIG. 1A shows the principal features of the vacuum tray, 1. The purpose of the tray frame, 2, is to surround the tray port, 3, on three sides and prevent the vacuum bag, 8, shown in FIG. 1B, from collapsing around the tray port, 3, during the vacuum packing operation. Without the tray frame, 2, the tray port, 3, would become clogged by the vacuum bag, 8, shown in FIG. 1B, and the vacuuming process would be prematurely stopped. The dimensions of the tray frame, 2, are scaled by the size of the vacuum bag, 8, shown in FIG. 1B, so as to take up most of the lateral space inside the vacuum bag, 8, but not be so tight as to prevent the vacuum bag, 8, from collapsing around the re-sealable bag, 14, shown in FIG. 1B, when a vacuum is drawn.

Although FIG. 1B depicts the height of the tray frame, 2, as uniform, in general the height will not be uniform but tailored to control how the vacuum bag, 8, shown in FIG. 1B, collapses around the re-sealable bag, 14, shown in FIG. 1C, and exerting pressure against the re-sealable bag seal, 15, shown in FIG. 1C. Specifically, the height of the tray frame, 2, near the open end of the vacuum tray, 1, may be made higher than that of other parts of the tray frame, 2, to prevent the vacuum bag, 8, shown in FIG. 1B, from prematurely collapsing on the re-sealable bag seal, 15, shown in FIG. 1C, and trapping excess air inside the re-sealable bag, 14.

FIG. 1A shows that the tray port, 3, is protected on its forth side and its bottom by the sealing shelf, 4, and tray well, 6, respectively. Collectively, the tray frame, 2, sealing shelf, 4, and tray well, 6, only allow the vacuum bag, 8, shown in FIG. 1B, to approach the tray port, 3, from the top. The downward movement of the vacuum bag, 8, during the vacuum operation is not sufficient to allow the vacuum bag, 8, to contact the tray port, 3.

The tray ramp, 5, shown in FIG. 1A, guides the re-sealable bag seal, 15, onto the sealing shelf, 4.

The tray well, 6, shown in FIG. 1A, collects fluids that may be forced from the re-sealable bag, 14, shown in FIG. 1C, during the vacuuming process and prevents such fluids from being aspirating into the electric vacuum pump, 11.

Users carry out the vacuum packing operation by placing food or other material into the re-sealable bag, 14, shown in FIG. 1C, leaving the re-sealable bag seal, 14, partially open. Next, the user inserts the re-sealable bag, 14, shown in FIG. 1C, through the open vacuum bag, 8, shown in FIG. 1B, until the re-sealable bag seal, 15, shown in FIG. 1C, rests on the sealing shelf, 4, shown in FIG. 1A. The user then turns on the vacuum source that is connected to the tray port, 3, shown in FIG. 1A, and leaves it on until the desired level of vacuum is obtained. As the vacuum increases, the top of the vacuum bag, 8, shown in FIG. 1B, collapses down onto the sealing shelf, 4, shown in FIG. 1A, and presses against the re-sealable bag seal, 15, shown in FIG. 1C. The pressure generated by the collapsing vacuum bag, 8, automatically closes the re-sealable bag seal, 15. This automatic closure feature is very important because once the re-sealable bag, 14, collapses around its contents; the re-sealable bag seal, 15, becomes immobile, and cannot be moved by hand. The collapsed bag freezes the re-sealable bag seal, 15, in place whether or not the re-sealable bag seal, 15, is closed or open. If the re-sealable bag seal, 15, is not closed, then the vacuum will be lost when the re-sealable bag, 14, is removed from the vacuum bag, 8. To complete the vacuuming process, the user turns off the vacuum source, opens the vacuum bag seal, 9, shown in FIG. 1B, and removes the vacuumed re-sealable bag, 14, shown in FIG. 1C.

Figure 2:
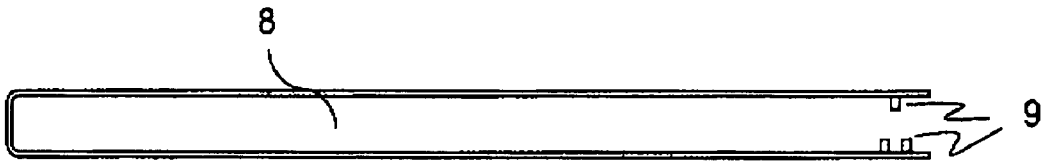
FIG. 2 is a cross sectional view of the large vacuum bag, 8.

FIG. 2 shows the vacuum bag, 8, prior to assembly to the other components of the system. The vacuum bag, 8, features a re-sealable vacuum bag seal, 9, and servers as the flexible vacuum chamber.

Figure 3:
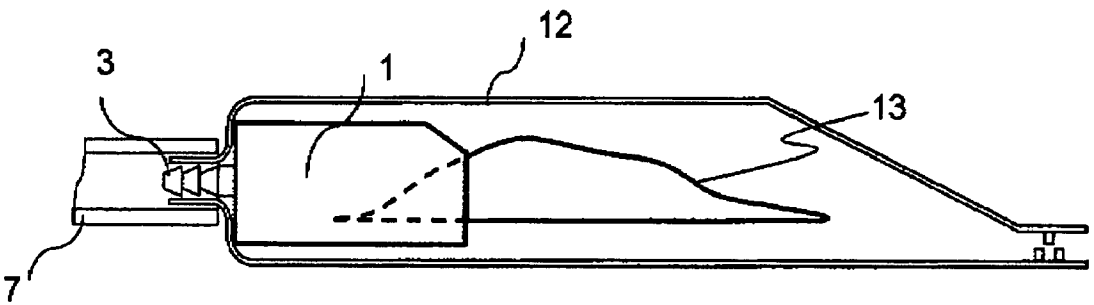
FIG. 3 shows the complete assembly after the vacuum tray, 1, has been mated to the vacuum hose, 7, and the expanded vacuum bag, 16, and the filled re-sealable bag, 17 has been inserted into the system.

FIG. 3 shows the details of the airtight connection between the system and a vacuum source. The airtight connection between the tray port, 3, vacuum hose, 7, and expanded vacuum bag, 16, is formed automatically during the assembly process. When the tray port, 3, is forced through the closed end of the expanded vacuum bag, 16, and into the vacuum hose, 7, the tray port, 3, punctures the thin wall of the expanded vacuum bag, 16, and simultaneously forms an airtight seal between the vacuum hose, 7, and the expanded vacuum bag, 16. This assembly step is performed before the system is shipped to the user, but may be repeated by the user if the original vacuum bag, 16, is damaged and must be replaced. A simple, compact, inexpensive, easy-to-install, airtight connection is crucial for a practical home food vacuum packing system because it affects both cost and user acceptance. Although there are many ways of making an airtight connection between a hose and a plastic bag, most use rubber seals, threaded connectors, and locking components to join the parts. Such components not only add bulk and cost, but also require users to be mechanically inclined and possess the tools needed to carry out the assembly process. The assembly method illustrated in FIG. 3 requires no gaskets, seals, or any other components or tools, and can be easily performed by the average person. The user simply inserts the tray port, 3, into the expanded vacuum bag, 16, and presses it into the vacuum hose, 7, until it stops.

Figure 4:
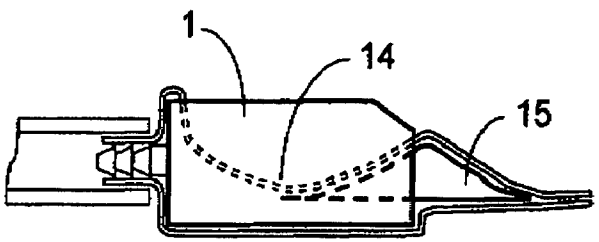
FIG. 4 shows the complete assembly after a vacuum has been drawn on the system.

FIG. 3 and FIG. 4 provide views of the assembly before and after a vacuum has been drawn on the system. FIG. 3 shows the filled re-sealable bag, 17, resting on the vacuum tray, 1, inside the expanded vacuum bag, 16. FIG. 4 depicts the assembly after vacuuming. The collapsed vacuum bag, 19, has compressed the collapsed filled re-sealable bag, 20, and forced excess air from the collapsed filled re-sealable bag, 20, and drawn the collapsed filled re-sealable bag, 20, toward the vacuum tray, 1.

Figure 5:
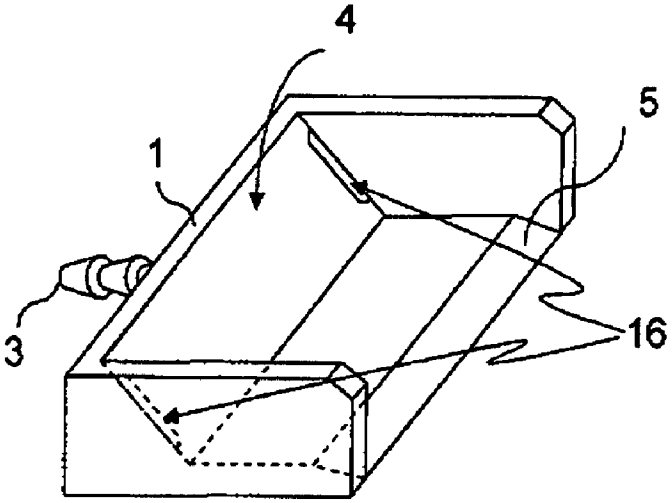
FIG. 5 shows an embodiment of the invention having an inclined sealing shelf, 4.

FIG. 5 depicts an embodiment of the vacuum tray, 1, having an inclined sealing shelf, 4, and tray ramp, 5. The angle of the inclined sealing shelf, 4, is chosen to match the angle that collapsing bags make with the vacuum tray, 1, to prevent collapsing bags from disrupting the sealing process. Two vacuum slots, 21, are located on opposite sides of the sealing shelf, 4, to provide air passages from the high-pressure side of the vacuum tray, 1, to the tray port, 3. Without such vacuum slots, 21, a collapsing bag could prematurely shut off flow to the tray port, 3.

Figure 6:
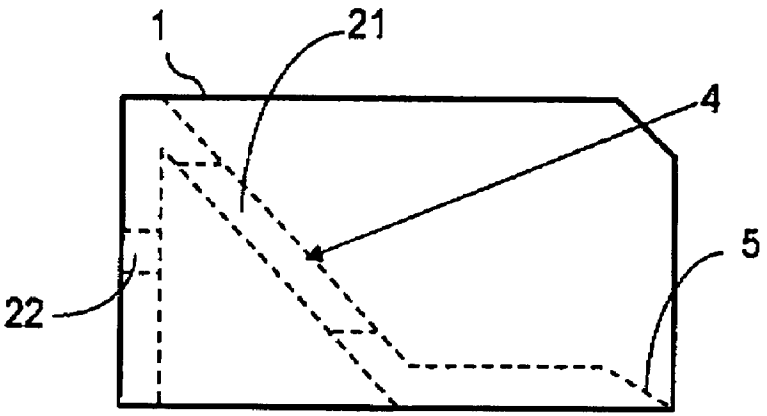
FIG. 6 gives a cross sectional view of the embodiment shown in FIG. 5.

FIG. 6 shows the profile of the internal features of a vacuum tray, 1, having an inclined sealing shelf, 4. Since the cavity between the sealing shelf, 4, and the tray port hole, 22, is empty, air may freely flow between the high-pressure side of the vacuum tray, 1, and the tray port hole, 22. The sealing shelf, 4, increases the mechanical strength of the assembly and also minimizes disruption of the sealing process by collapsing bags. In particular, a collapsing outer bag can separate the two halves of the inner re-sealable bag seal. When this happens the inner re-sealable bag will not be sealed closed and the vacuum operation will not be successful. The inclined sealing shelf, 4, places the re-sealable bag seal on a plane that better matches the plane of the collapsing outer bag and thereby minimizes relative displacements of the two halves of the re-sealable bag seal.

Figure 7:
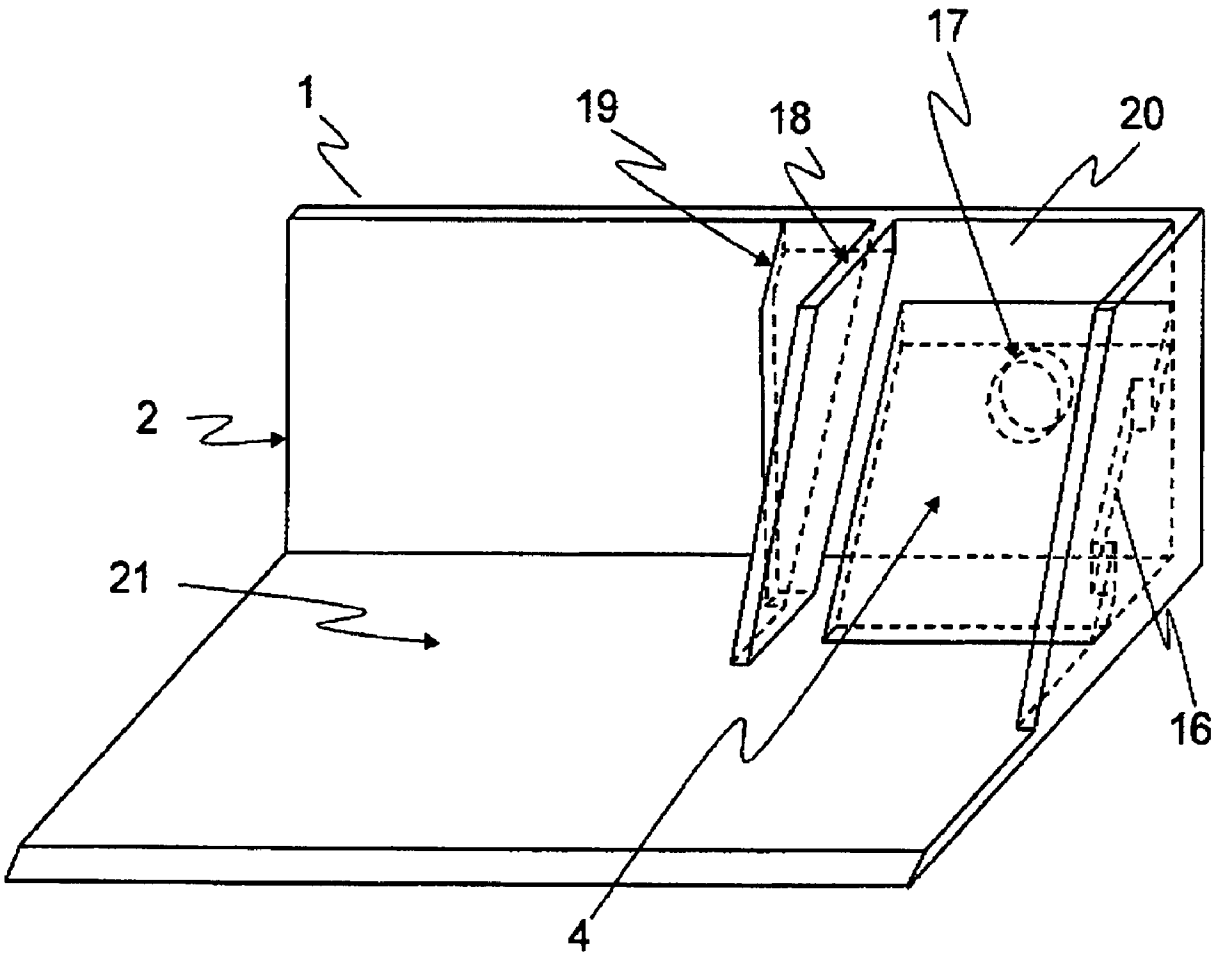
FIG. 7 shows the preferred embodiment of the invention for re-sealable bags that close without zippers.

FIG. 7 shows the preferred embodiment of the invention for re-sealable bags that don't have zippers. This embodiment allows the vacuum tray, 1, to be used with any size outer bag because the vacuum tray, 1, fits in the corner of the outer bag, and the tray frame, 2, is open on one end. The corner fit and the open tray frame, 2, allows the outer bag to collapse around the vacuum tray, 1, in the same way, independent of the size of the outer bag. The embodiment shown in FIG. 7 also features a channel, 21, that controls how the outer bag collapses around the seals of non-zipper re-sealable bags. Specifically, it constrains the outer bag to collapse in a uniform way onto the inclined sealing shelf, 4. The channel is formed by one end of the tray frame, 2, and an inclined arm, 23. The arm, 23, is structurally reinforces with a flange, 25 that prevents the arm, from deflecting under the forces caused by the vacuum. There are gaps between the top surface of the tray base, 26, and the bottom of the arm, 23; and between the upper surface of the sealing shelf, 4, and the edge of the arm, 23, to allow the re-sealable bag to slide onto the sealing shelf, 4, without being obstructed by the arm, 23. The vacuum slot 21, on the edge of the sealing shelf, 4, provides an additional vacuum path between the tray port hole, 22, and the seal of the re-sealable bag. Users operate the device by partially closing the re-sealable bag; then sliding the unsealed portion of the re-sealable bag under the arm, 23, and onto the sealing shelf, 4. The vacuum and bag-removal steps are the same as for other embodiments of the invention.

Figure 8:
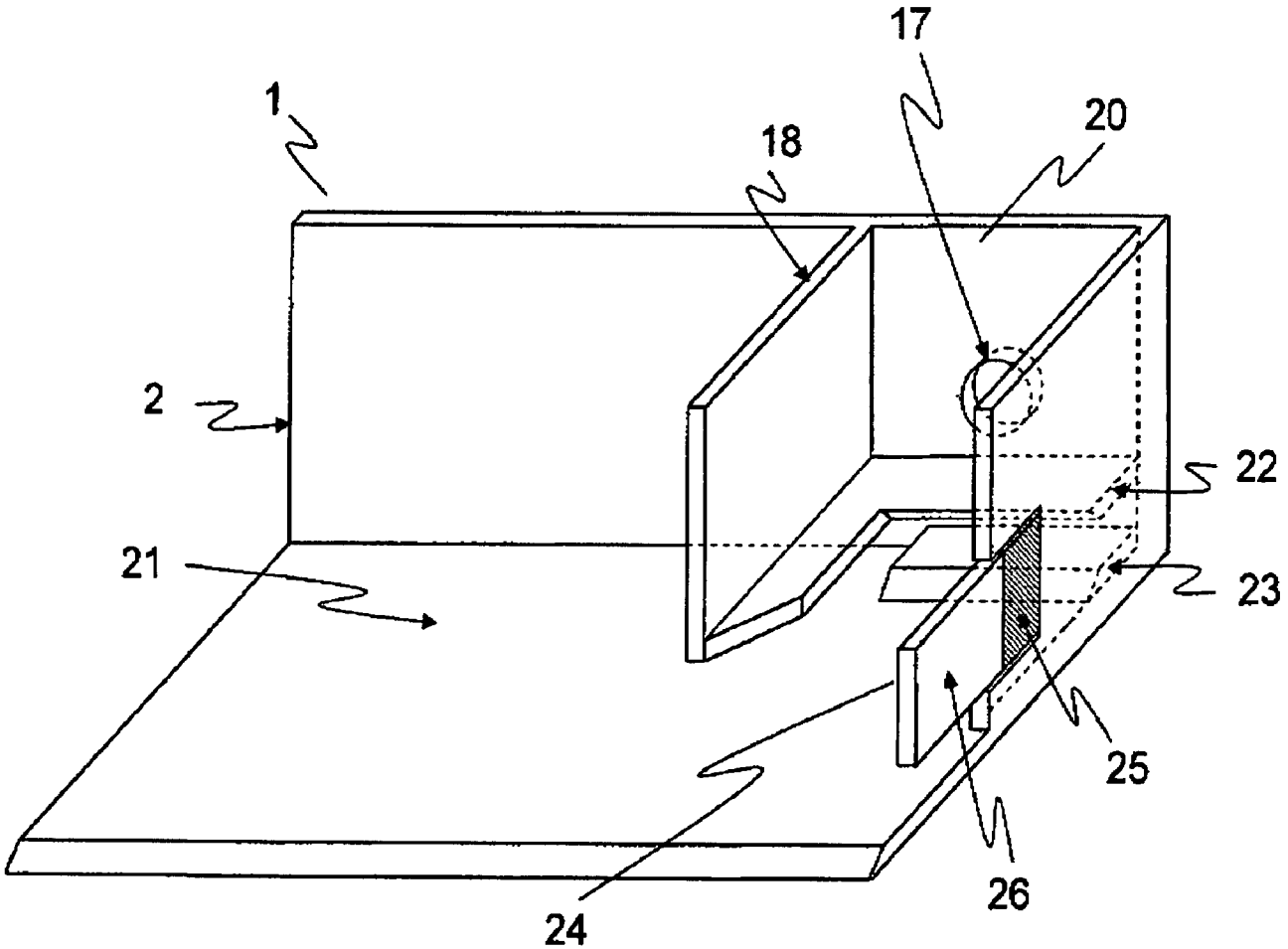
FIG. 8 shows an embodiment of the invention designed to work with re-sealable bags that incorporate zippers in the sealing mechanism.

FIG. 8 shows an embodiment of the invention designed to work with re-sealable bags that incorporate zippers in the sealing mechanism. This embodiment of the invention is similar in construction to the embodiment shown in FIG. 7, and works with any size outer bag. The main difference is that the embodiment shown in FIG. 8 features a zipper flap, 29, that slides the zipper shut as the outer bag collapses. The zipper flap consists of a spring hinge, 28, and a plate, 30, bonded together. The spring hinge, 28, fits into a recess on the closed end of the tray frame, 2, and is protected from the collapsing bag. The spring hinge may be made of rubber or some other elastic material that restores the zipper flap, 20, to a straight position after the re-sealable bag is removed from the vacuum tray, 1. There is a gap between the top surface of the tray base, 26, and the bottom of the arm, 23, that allows users to slide the zipper re-sealable bag into the bottom of the channel, 21. Users operate the device by partially closing the zipper re-sealable bag; leaving only about a quarter of an inch open; then sliding the unsealed portion of the zipper re-sealable bag under the arm, 23, and between the top guide, 27, and the bottom guide, 28. The top guide, 27, and the bottom guide, 28, not only help guide the end of the zipper re-sealable bag into the correct position, and also help prevent buckling of the seal as the zipper is automatically moved to the closed position. As the outer bag collapses, the plate, 30, is forced into the channel, 21, formed by the arm, 23, and the closed end of the tray frame, 2. This movement of the plate, 30, causes it to impinge upon the zipper of the zipper re-sealable bag and slide the zipper shut. The open structure of the vacuum tray, 1, affords ample paths for air to be extracted through the tray port hole, 22.

Numerous modifications to and alternative embodiments of the present invention will be apparent to those skilled in the art in view of the foregoing description. Accordingly, this description is to be construed as illustrative only and is for the purpose of teaching those skilled in the art the best modes of carrying out the invention. Details of the system may be varied substantially without departing from the spirit of the invention and the exclusive use of all modifications which come within the scope of the appended claims is reserved.

What is claimed is:

1. A method for evacuating air from a re-sealable plastic bag possessing an integral mechanical seal, and requiring on no other means for closing the bag, by, inserting the re-sealable flexible bag, partially opened, entirely inside a larger outer re-sealable flexible bag that constitutes a vacuum chamber having flexible walls, and a re-sealable mechanical seal, closing the re-sealable mechanical seal of the larger outer re-sealable flexible bag, evacuating the air inside the outer re-sealable flexible bag prior to closing the inner re-sealable flexible bag, automatically closing the mechanical seal of the inner re-sealable flexible bag by using atmospheric pressure transmitted through the flexible walls of the outer re-sealable flexible bag, onto the mechanical seal of the inner re-sealable bag, prior to removing the vacuum.

2. Apparatus for evacuating air from an inner re-sealable flexible bag possessing an integral mechanical seal, and requiring on no other means for closing the bag, comprising, a second, outer re-sealable flexible bag, possessing an integral mechanical seal, and which is larger than the inner re-sealable flexible bag, and which constitutes a flexible-walled vacuum chamber, into which the inner re-sealable flexible bag is inserted, a vacuum pump that draws a vacuum on the outer re-sealable flexible bag, a vacuum tray having a bottom surface surrounded by vertical walls, and a vacuum port disposed on one of the vertical walls, arranged so as to prevent the outer re-sealable flexible bag from blocking the vacuum port, wherein said vacuum tray further includes mechanisms that facilitate automatically closing the inner re-sealable flexible bag after the desired vacuum level has been reached, and while the inner re-sealable flexible bag is still inside the outer re-sealable flexible bag, and the mechanical seal on the outer re-sealable flexible bag is still closed.

* * * * *